United States Patent [19]

Murphy

[11] Patent Number: 4,981,382

[45] Date of Patent: Jan. 1, 1991

[54] CLIP ACTUATED LATCH MECHANISM FOR RETRACTABLE WRITING INSTRUMENTS

[76] Inventor: Kent D. Murphy, 6 Convent Lane, Skerries, Co. Dublin, Ireland

[21] Appl. No.: 417,065

[22] Filed: Oct. 4, 1989

[51] Int. Cl.[5] ..... B43K 24/02

[52] U.S. Cl. ..... 401/104; 401/109

[58] Field of Search ..... 401/114, 113, 109, 104

[56] References Cited

U.S. PATENT DOCUMENTS 3,288,114 11/1966 Ritter ..... 401/104

FOREIGN PATENT DOCUMENTS 1303561 8/1962 France ..... 401/104
1336209 7/1963 France ..... 401/104
362621 7/1962 Switzerland ..... 401/1004
979882 1/1965 United Kingdom ..... 401/104

*Primary Examiner*—Richard J. Johnson
*Attorney, Agent, or Firm*—Brady, O'Boyle & Gates

[57] ABSTRACT

A rolling ball writer having a writing component carrier that slides within the barrel of the instrument in a manner similar to a ball point pen cartridge and utilizes a compression button and latching system at one end which extends and secures, respectively, the writing tip in an exposed position at the end of the barrel opposite said button, and which also has a release button incorporated on its clip which, when pressed, releases said latching system and allows an internal spring to bias said writing tip to a retracted position.

21 Claims, 4 Drawing Sheets

CLIP ACTUATED LATCH MECHANISM FOR RETRACTABLE WRITING INSTRUMENTS

BACKGROUND OF THE INVENTION

The present invention seeks to provide a retracting mechanism for rolling ball writers, a very popular writing instrument on the market that in all its present variations incorporates a cap which must be removed before use and subsequently refitted after use, by utilization of a retracting mechanism which provides greater convenience and ease in use and which is more efficient in manufacture than known retracting mechanisms in the prior art.

SUMMARY OF THE INVENTION

More particularly, the invention is to provide a rolling ball writer having a writing components carrier that slides within the barrel of the instrument in a manner similar to a ball point pen cartridge and utilizes a compression button and latching system at one end which extends and secures, respectively, the writing tip in an exposed position at the end of the barrel opposite said button, and which also has a release button incorporated on its clip which, when pressed, releases said latching system and allows an internal spring to bias said writing tip to a retracted position.

Another object of the invention is to provide a retracting mechanism for ball point pen cartridges similar to that of the aforesaid rolling ball writer.

Another object of the invention is to provide a retracting mechanism for rolling ball writers and ball point pens having an enlarged, pronounced retracting button positioned externally on the side of the barrel of the instrument, representing an improvement functionally over other mechanisms which incorporate release means accessed through the side of the instrument.

DETAILED DESCRIPTION

Figure 1:
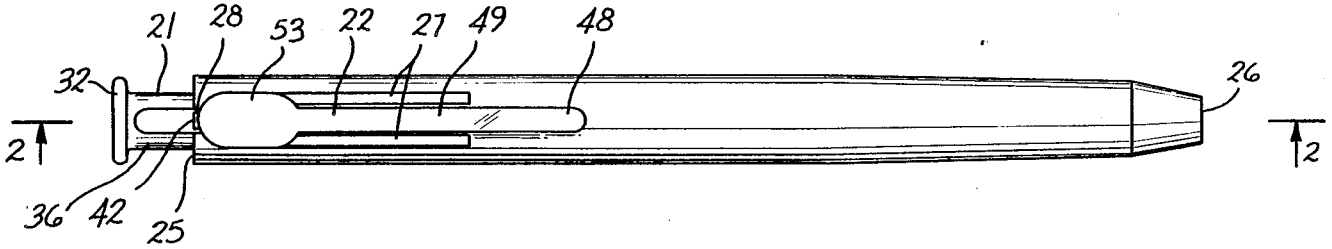
FIG. 1 is a plan view of the writing instrument in its retracted state.
Figure 2:
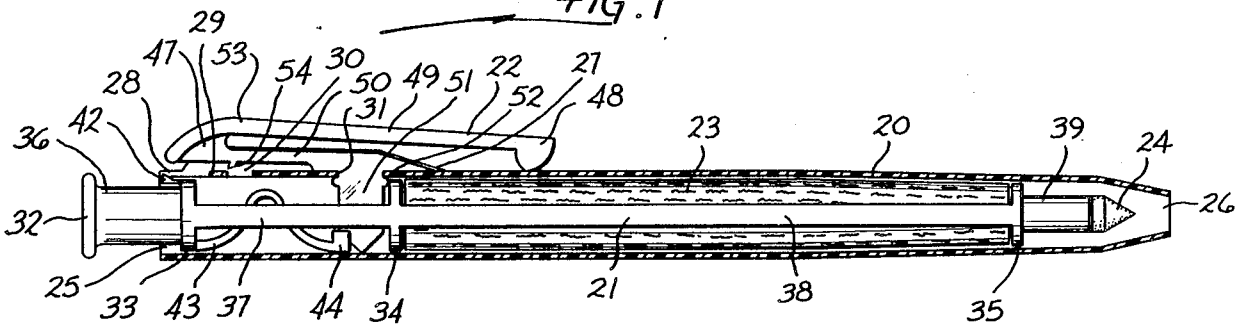
FIG. 2 is a longitudinal sectional view of FIG. 1 with the barrel cutaway, taken substantially along line 2—2 of FIG. 1.

Referring to the drawings in detail wherein like numerals designate like parts, and referring initially to FIGS. 1 through 7, a rolling ball writer according to the present invention is shown that mechanically retracts.

The instrument has a barrel 20 having a rear opening 25 and a front opening 26. Extending longitudinally on the outer surface of one side of said barrel 20 from said insertion end 25 are two parallel guides 27, with there being situated between said guides 27 a travel opening 28, a stop 29, a stop opening 30, and a clip fixing opening 31.

The instrument has an elongate writing components carrier 21, welded of plastic, incorporating two diametrically opposing rear push arms 36 perpendicularly connecting a compression button 32 and a rear disk 33, two diametrically opposing middle push arms 37 perpendicularly connecting said rear disk 33 and a middle disk 34, and two diametrically opposing front push arms 38 perpendicularly connecting said middle disk 34 and a front disk 35. Positioned between said middle disk 34 and said front disk 35 is a plastic wrapped fibrous writing fluid reservoir 23, which is supported laterally by said front push arms 38. Centrally located on said front disk 35 is a cylindrical tip fixing sleeve 39 extending directionally away from said middle disk 34, with said tip fixing sleeve 39 having a centrally located tip opening 40 into which is frictionally engaged a writing tip 24, said writing 24 having an absorption extension 41 which passes through said tip opening 40 and enters into said writing fluid reservoir 23 such that it draws writing fluid into said writing tip 24.

Extending directionally toward said compression button 32 from the circumference of said rear disk 33 is a resilient securing tab 42, which securing tab 42 is located on said rear disk 33 at right angle to the diameter on which the aforesaid rear push arms 36 are situated on the reverse side of said rear disk 33. The shape of said securing tab 42 approximates that of a right triangle, having its hypotenuse facing away from said compression button 32 and having said hypotenuse extending beyond the circumference of said rear disk 33 to which it is attached.

Extending directionally toward said middle disk 34 from the circumference of said rear disk 33 is an integral molded wavy compression spring 43, which compression spring 43 is positioned on said rear disk 33 diametrically opposed to the aforesaid securing tab 42 found on the reverse side of said rear disk 33. Incorporated at the end opposite the connection the end connected to said rear disk 33 is a heightened U-shaped connector 44.

The instrument has a flat resilient plastic clip 22 for securing the instrument to a shirt pocket, which clip 22 has a joining end 47 opposite a shirt engaging end 48, with an outer length 49 running between said joining end 47 and said shirt engaging end 48, and an inner length 50, which inner length 50 runs from said curved end 47 directionally toward said shirt engaging end 48, with said inner length 50 being slightly more than half the length of said outer length 49. Incorporated on said inner length 50 at the end opposite said joining end 47 is a clip connector 51 on which there are locking tabs 52 on either side. Said clip 22 incorporates a release button 53 formed perpendicularly on said outer length 49 at said curved end 47. Incorporated on said inner length 50 and projecting directionally away from said release button 53 is a release lug 54. In its retracted position shown in FIGS. 1 and 2, said writing components carrier 21 is positioned such that the aforesaid compression button 32 and substantially all of said rear push arms 36 extend out said rear opening 25 and the aforesaid securing tab 42 is positioned in said travel opening 28 near to said rear opening 25. The said clip connector 51 is inserted inside said barrel 20 through the aforesaid clip fixing opening 31, with the aforesaid locking tabs 52 snapping over the wall thickness of said barrel 20 to secure the connection of said clip 11 to said barrel 20, such that the aforesaid inner length 50 and release lug 54 are positioned in spaced relationship to said barrel 20 and the aforesaid stop opening 30, with said release lug 54 being positioned immediately adjacent to said stop opening 30. The accurate movement and anchoring of said inner length 50 and said clip connector 51, respectively, are enhanced by being closely bound by the aforesaid guides 27, which guides 27 also taper into said barrel 20 such that when said instrument is slipped into a pocket, the cloth smoothly glides along said guides 27 and avoids engaging and being interfered with by said inner length 50 and clip connector 51. Said clip connector 51 extends within said barrel 20 and is positioned between the aforesaid middle disk 34 and the aforesaid U-shaped connector 44 such that said clip connector 51 secures the position of said writing components carrier 21 within said barrel 20, as said clip connector 51 abuts up against said middle disk 34 to inhibit the removal of said writing components carrier 21 from said barrel 20 through said rear opening 25 and said clip connector 51 interconnects with said U-shaped connector means 44 such that the aforesaid compression spring 43 biases said writing components carrier 21 into a secure retracted position such that the aforesaid writing tip 24 is concealed within the said barrel 20 at the aforesaid front opening 26.

Figure 3:
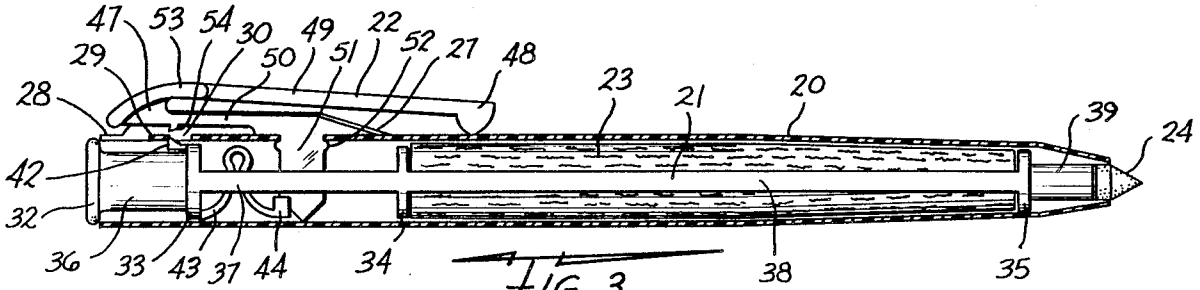
FIG. 3 is a view of FIG. 2 showing the instrument in its extended state.
Figure 4:
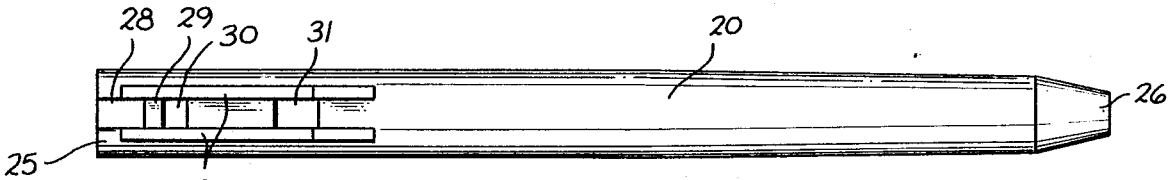
FIG. 4 is a plan view of the barrel of the instrument.
Figure 5:
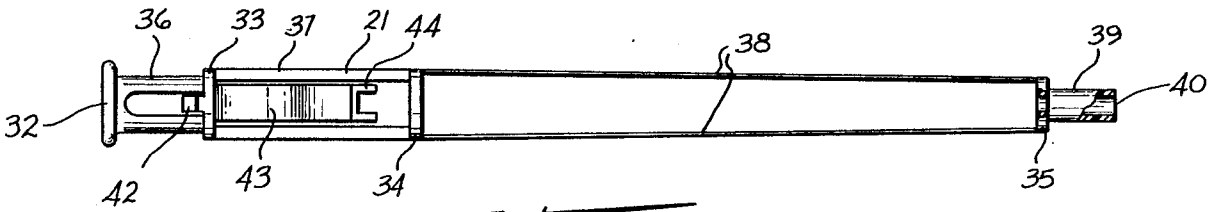
FIGS. 5, 6, and 7 are plan views of the elements of the writing components carrier.
Figure 7:
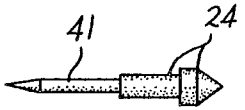
Figure 6:
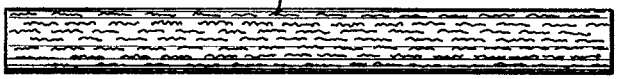

Pressure applied to the aforesaid compression button 32 causes the compression of the aforesaid compression spring 43 between the aforesaid rear disk 33 and the aforesaid clip connector 51, thus causing the longitudinal movement of the aforesaid writing components carrier 21 through the aforesaid barrel 20 toward the aforesaid front opening 26 such that the aforesaid writing tip 24 extends out said front opening 26, exposing it for use. Additionally, the said movement causes the aforesaid securing tab 42 to travel down the aforesaid travel opening 28 and then flex to pass under the aforesaid stop 29, whereupon continued longitudinal movement brings said securing tab 42 to the aforesaid stop opening 30, whereupon said flexed securing tab 42 relaxes such that it abuts up against said stop 29, securing said writing components carrier 21 in the extended position, as seen in FIG. 3.

Pressure on the aforesaid release button 53 applied directionally toward the aforesaid barrel 20 causes the aforesaid inner length 50 to flex, causing the aforesaid release lug 54 to protrude into the aforesaid stop opening 30 and abut up against the aforesaid securing tab 42 and transfer said pressure to same, whereupon said securing tab 42 flexes and disengages from the aforesaid stop 29, whereupon the heretofore compressed compression spring 43 biases to its relaxed position, whereupon the said flexed securing tab 42 passes under the aforesaid stop 29 and then relaxes and travels up the aforesaid travel opening 28 until the aforesaid middle disk 34 abuts up the aforesaid clip connector 51, bringing the said writing components carrier 21 to rest in its retracted position.

Figure 8:
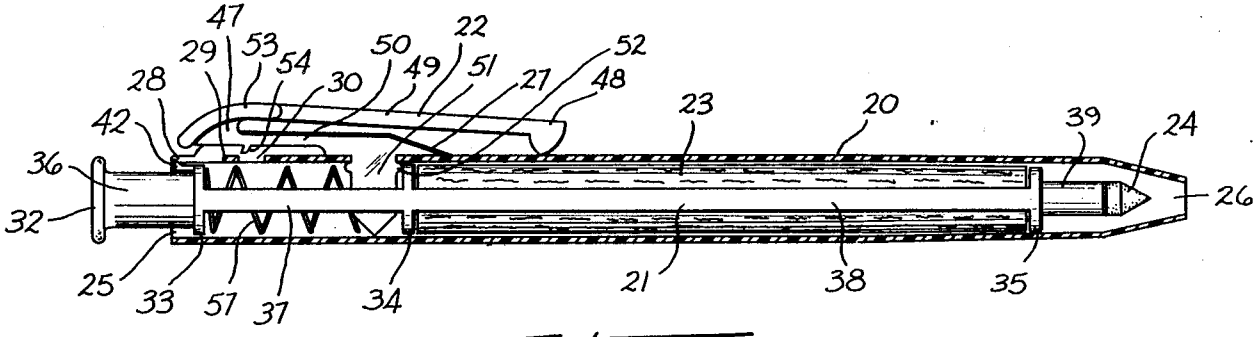
FIG. 8 is another side view similar to FIG. 2 showing a second embodiment.

FIG. 8 is a second embodiment wherein the aforesaid integral wavy plastic compression spring 43 is replaced by a non-integral metal accordion spring 57 which abuts against the aforesaid rear disk 33 and the aforesaid clip connector 51. This second embodiment functions in like manner as the first embodiment, and like reference numerals refer to like members shown in FIGS. 1 through 7, and a description of those members is omitted.

Figure 9:
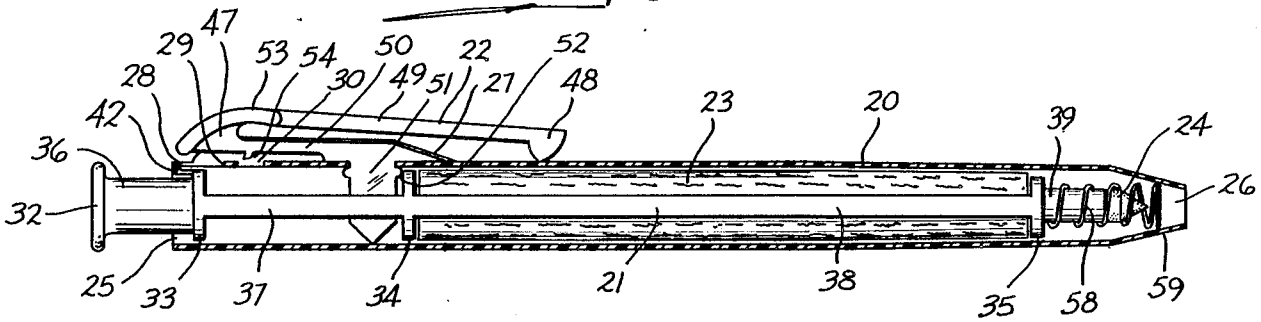
FIG. 9 is another side view similar to FIG. 2 showing a third embodiment.

FIG. 9 is a third embodiment wherein the aforesaid integral wavy compression spring 43 is replaced by a non-integral metal coil spring 58 which slips over the aforesaid tip fixing sleeve 39 and abuts against the aforesaid front disk 35 and the tapering 59 of the aforesaid barrel 20 near the aforesaid front opening 26. This third embodiment functions in like manner as the first embodiment, and like reference numerals refer to like members shown in FIGS. 1 through 7, and a description of those members is omitted.

Figure 10:
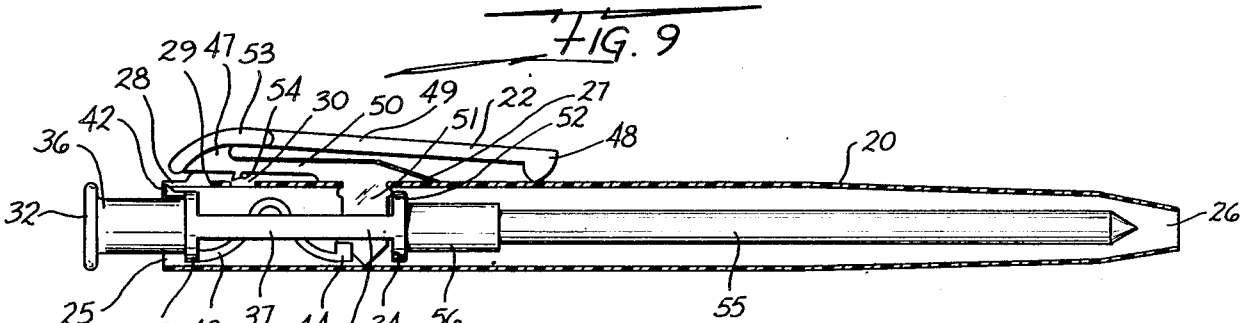
FIG. 10 is a side view similar of FIG. 2 showing a fourth embodiment.

FIG. 10 is a fourth embodiment wherein the aforesaid writing components carrier 21 has been modified to eliminate the aforesaid front push arms 38, front disk 35, and tip fixing sleeve 39, rendering the instrument into a ball point pen rather than a rolling ball writer. A ball point pen cartridge 55 is frictionally inserted into a cartridge fixing sleeve 56, which is centrally located on the aforesaid middle disk 34 on the side opposite the side which abuts against the aforesaid clip connector 51. This fourth embodiment functions in like manner as the first embodiment. Excepting reference numeral 21, where like members have undergone the above detailed changes, all other like reference numerals refer to like members shown in FIGS. 1 through 7, and a description of those members is omitted.

Figure 11:
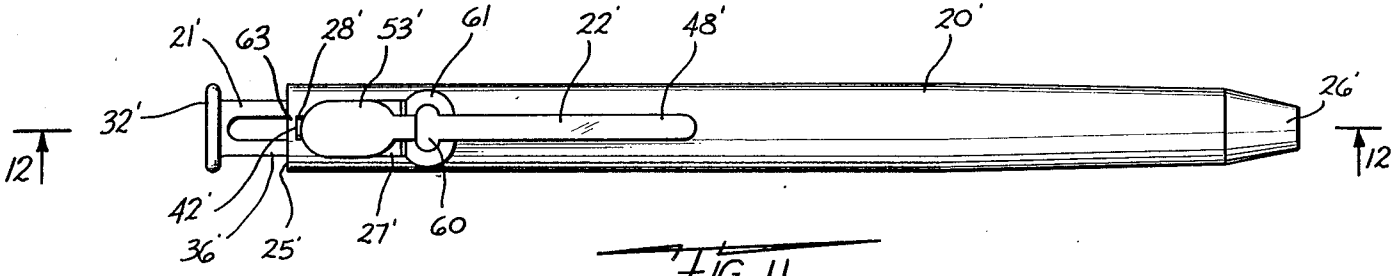
FIG. 11 is a plan view of a fifth embodiment.
Figure 12:
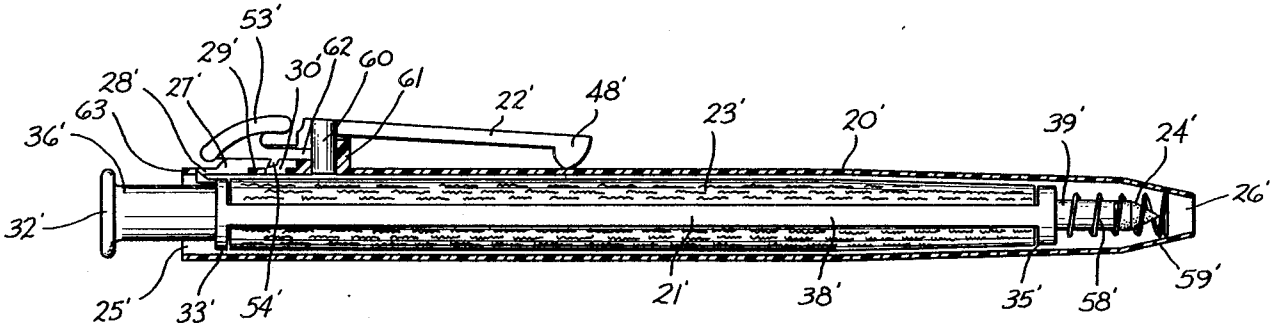
FIG. 12 is a longitudinal sectional view of FIG. 11 with the barrel cutaway, taken substantially along line 12—12 of FIG. 11.

FIGS. 11 and 12 show a fifth embodiment incorporating the metal coil spring 58' abutting on the tapering of the barrel 20', the same as shown in FIG. 10 at 58. In this embodiment, the aforesaid clip connector 51 is eliminated and the plastic clip 22' incorporates a post 60 which is positioned on said clip 22' directionally opposite the shirt engaging end 48' and which is frictionally engaged within an external connector 61 rising from the barrel 20'. Said post 60 has extending from it directionally opposite that of the said shirt engaging end 48' a resilient extension 62 positioned in spaced relationship to said barrel 20' and having incorporated thereon a release button 53' and a release lug 54'. In the absence of a clip connector 51 extending into said barrel 20' to provide means for retaining the aforesaid writing components carrier 21' within said barrel 20', a retaining stop 63 is provided where the travel opening 28' joins the rear opening 25' or barrel 20', such that the securing tab 42' abuts upon said retaining stop 63 to retain said writing components carrier 21' within said barrel 20'. In the absence of an inner length 50 and a clip connector 51 on said clip 22', the guides 27' serve only to guide the movement of the extension 62, toward and away from the barrel 20', as the need to serve as a guide for the cloth of a pocket has been eliminated. This fifth embodiment functions in like manner as the first embodiment. The components carrier 21' in this form of the invention includes a pair of long, spaced apart push arms 38' extending between rear disk 33' and front disk 35' with a much longer plastic wrapped fibrous writing fluid reservoir 23' supported longitudinally between the respective disks 33' and 35' and laterally between the pair of push arms 38'. When compression button 32' is pushed in toward barrel 20' to extend writing tip 24' from opening 26' in the barrel, securing tab 42' welded onto the plastic carrier 21' is cammed under stop 29' and then snaps up into stop opening 30' against stop 29' to retain the tip in extended writing position To retract the tip into barrel 20' under the action of compressed spring 58', release button 53' is depressed, flexing resilient extension 62 toward barrel 20' and release lug 54' against securing tab 42' in stop opening 30', thus flexing securing tab 42' below and out of contact with stop 29', whereafter it moves beneath stop 29' under the urging of spring 58' and then flexes up into travel opening 28' and comes to rest against retaining stop 63, which functions to retain carrier 21' in the barrel. To remove carrier 21' from the barrel to replace reservoir 23', tab 42' is depressed beneath retaining stop 63 and the carrier 21' is removed from barrel 20' by pulling it out longitudinally with button 32'. Excepting reference numerals 22', 27', 53', and 54', where like members have undergone the above detailed changes, all other like primed reference numerals refer to like members shown in FIGS. 1 through 7, and a description of those members is omitted.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A writing instrument comprising, a hollow barrel having a tapered forward end with a front opening and an open rear end, a writing components carrier slidable into said barrel through said open rear end and having a rear button portion extending from said open rear end and a forward portion, writing fluid reservoir and writing tip means connected on said forward portion inside said barrel, spring means operatively connected between said barrel and carrier normally biasing said carrier to a retracted position in which the writing tip means is concealed within the tapered forward end of said barrel, resilient clip means ,connector means rigidly connecting said resilient clip means to said barrel adjacent said open rear end, said resilient clip means having an elongate retainer portion extending forwardly toward said tapered forward end of said barrel and a resilient cantilevered portion extending rearwardly toward said open rear end from said connector means and in spaced relation to said barrel, a pair of parallel raised guides on said barrel positioned on opposite sides of said resilient cantilevered portion, a release lug on said resilient cantilevered portion extending toward said barrel, said barrel having a stop opening therethrough with a stop surface positioned beneath said release lug, a resilient tab on said carrier, whereby upon application of pressure to said rear button said carrier slides longitudinally forwardly in said barrel against the biasing force of said spring means and said writing tip mans extends outwardly through said front opening to the extending position and said resilient tab moves into said stop opening into engagement with said stop surface to maintain the writing tip means in extended position, and upon application of pressure on said resilient clip means laterally toward said barrel said resilient cantilevered portion flexes toward said barrel to move said release lug into contact with said resilient tab in said stop opening and to move said resilient tab out of contact with said stop surface causing said carrier and writing tip means to return to the said retracted position by the biasing force of said spring means.

2. A writing instrument as set forth in claim 1, in which said resilient cantilevered portion is disposed outwardly of and substantially parallel with said barrel, and laterally inwardly of said elongate retainer portion.

3. A writing instrument as set forth in claim 2, said elongate retainer portion having an end adjacent said open rear end of the barrel connected to said resilient cantilevered portion, and a substantially large surface release button formed on said end of said elongate retainer portion connected to said resilient cantilevered portion.

4. A writing instrument as set forth in claim 1, in which said carrier includes a middle portion between said rear button portion and said forward portion, said forward portion including a lateral stop surface, said middle portion comprising spaced parallel arms connected between said rear button portion and said lateral stop surface, and said connector means comprising an anchoring lug connected through said barrel and laterally interior of said hollow barrel forming a stop for said lateral stop surface.

5. A writing instrument as set forth in claim 4, in which said spring means is connected between said rear button portion and said anchoring lug.

6. A writing instrument as set forth in claim 5, in which said spring means and anchoring lug are positioned between said spaced parallel arms of said middle portion of said carrier.

7. A writing instrument as set forth in claim 5, in which said spring means is integrally connected with said rear button portion and is molded of plastic material with said carrier.

8. A writing instrument as set forth in claim 5, in which said spring means comprises a metal spring positioned between said parallel arms.

9. A writing instrument as set forth in claim 1, in which said spring means is connected inside said hollow barrel between a portion of said hollow barrel and said forward portion of said carrier.

10. A writing instrument as set forth in claim 4, in which said spring means is connected inside said hollow barrel between said tapered forward end and said forward portion of said carrier.

11. A writing instrument as set forth in claim 4, and said forward portion of said carrier includes a front end plate having an aperture therethrough, a pair of laterally spaced arms extending between said lateral stop surface and said front end plate, said writing fluid reservoir positioned between said laterally spaced arms, said lateral stop surface and said front end plate, and said writing tip means extending forwardly from said front end plate and having a portion extending through said aperture in said front end plate and into said writing fluid reservoir.

12. A writing instrument as set forth in claim 4, in which said forward portion of said carrier includes a hollow sleeve extending forwardly from said lateral stop surface, and said writing fluid reservoir and writing tip means engaged in said hollow sleeve.

13. A writing instrument as set forth in claim 1, in which said barrel having a second opening therethrough in longitudinal alignment with said stop opening, and said resilient tab on said carrier positioned in said second opening in the retracted position of said carrier.

14. A writing instrument as set forth in claim 13, and said second opening having a retaining stop edge, and said resilient tab disposed in abutment with said retaining stop edge in the retracted position of said carrier preventing removal of said carrier from said hollow barrel through said open rear end.

15. A writing instrument as set forth in claim 1, in which said connector means for said resilient clip means comprises an external socket substantially normal on said barrel, and substantially normal post means in said resilient clip means connected in said socket.

16. A writing instrument as set forth in claim 15, in which said elongate retainer portion is connected to said post means and extends forwardly therefrom toward said tapered forward end, and said resilient cantilevered portion is connected to said post means and extends rearwardly therefrom toward said open rear end.

17. A writing instrument as set forth in claim 6, and a substantially large surface release button formed on the free end of said resilient cantilevered portion.

18. A writing instrument comprising, a hollow barrel having a tapered forward end with a front opening and an open rear end, a writing components carrier slidable into said barrel through said open rear end and having a rear button portion extending from said open rear end and a forward portion, writing fluid reservoir and writing tip means connected on said forward portion inside said barrel, said forward portion of said carrier including a front end plate having an aperture therethrough, a pair of laterally spaced arms extending rearwardly from said front end plate, said writing fluid reservoir positioned between said laterally spaced arms, said writing tip means extending forwardly from said front end plate and having a portion extending through said aperture in said front end plate and into said writing fluid reservoir, spring means operatively connected between said barrel and carrier normally biasing said carrier to a retracted position in which the writing tip means is concealed within the tapered forward end of said barrel, resilient clip means, connector means rigidly connecting said resilient clip means to said barrel adjacent said open rear end, said resilient clip means having an elongate retainer portion extending forwardly toward said tapered forward end of said barrel and a resilient cantilevered portion extending rearwardly toward said open rear end from said connector means and in spaced relation to said barrel , a release lug on said resilient cantilevered portion extending toward said barrel, said barrel having a stop opening therethrough with a stop surface positioned beneath said release lug, a resilient tab no said carrier, whereby upon application of pressure to said rear button said carrier slides longitudinally forwardly in said barrel against the biasing force of said spring means and said writing tip means extends outwardly through said front opening to the extended position and said resilient tab moves into said stop opening into engagement with said stop surface to maintain the writing tip means in extending position, and upon application of pressure on said resilient clip means laterally toward said barrel said resilient cantilevered portion flexes toward said barrel to move said release lug into contact with said resilient tab in said stop opening and to move said resilient tab out of contact with said stop surface causing said carrier and writing tip means to return to the said retracted position by the biasing force of said spring means.

19. A writing instrument as set forth in claim 18, including a sleeve connected to and extending forwardly from said front end plate, and said writing tip means connected in said sleeve.

20. A writing instrument comprising, a hollow barrel having a tapered forward end with a front opening and an open rear end, a writing components carrier slidable into said barrel through said open rear end and having a rear button portion extending from said open rear end and a forward portion, writing fluid reservoir and writing tip means connected on said forward portion inside said barrel, spring means operatively connected between said barrel and carrier normally biasing said carrier to a retracted position in which the writing tip means is concealed within the tapered forward end of said barrel, resilient clip means, connector means rigidly connecting said resilient clip means to said barrel adjacent said open rear end, said resilient clip means having an elongate retainer portion extending forwardly toward said tapered forward end of said barrel and a resilient cantilevered portion extending rearwardly toward said open rear end from said connector means and in spaced relation to said barrel, said connector means comprising an external socket substantially normal on said barrel, and substantially normal post means on said resilient clip means rigidly connected in said external socket, a release lug on said resilient cantilevered portion extending toward said barrel, said barrel having a stop opening therethrough with a stop surface positioned beneath said release lug, a resilient tab on said carrier, whereby upon application of pressure to said rear button said carrier slides longitudinally forwardly in said barrel against the biasing force of said spring means and said writing tip means extends outwardly through said front opening to the extended position and said resilient tab moves into said stop opening into engagement with said stop surface to maintain the writing tip means in extended position, and upon application of pressure on said resilient clip means laterally toward said barrel said resilient cantilevered portion flexes toward said barrel to move said release lug into contact with said resilient tab in said stop opening and to move said resilient tab out of contact with said stop surface causing said carrier and writing tip means to return to the said retracted position by the biasing force of said spring means.

21. A writing instrument as set forth in claim 20, in which said elongate retainer portion is connected to said substantially normal post means and extends forwardly therefrom toward said tapered forward end, and said resilient cantilevered portion is connected to said substantially normal post means and extends rearwardly therefrom toward said open rear end.

* * * * *